US006396219B1

(12) United States Patent
Tang

(10) Patent No.: US 6,396,219 B1
(45) Date of Patent: May 28, 2002

(54) FLASHER STRING

(76) Inventor: Ti-Ming Tang, No. 10, Dah Yong Road, Hukou Shiang, Hsinchu Hsien (TW)

( * ) Notice: Subject to any disclaimer, the term of this patent is extended or adjusted under 35 U.S.C. 154(b) by 0 days.

(21) Appl. No.: 09/680,398

(22) Filed: Oct. 5, 2000

(51) Int. Cl.[7] ..... H05B 37/00
(52) U.S. Cl. ..... 315/185 S; 315/94; 315/100
(58) Field of Search ..... 315/185 S, 185 R, 315/200 A, 312–324, 49–60, 94, 226, 95–101

(56) References Cited

U.S. PATENT DOCUMENTS 5,610,479 A * 3/1997 Schmitt ..... 315/226
5,886,423 A * 3/1999 Gershen et al. ..... 315/185 S
6,107,746 A * 8/2000 Chen ..... 315/185 S

* cited by examiner

*Primary Examiner*—Don Wong
*Assistant Examiner*—Wilson Lee

(57) ABSTRACT

A flasher string which includes a plurality of flashers connected in series and a plurality of thyrsitor diodes, each thyrsitor diode connected to a respective flasher in parallel. The flasher can periodically turn on and off to produce a twinkling light due to thermal distortion of the metal piece in the flasher. When the flasher turns on, the metal piece normally contacting the filament of the flasher is heated to expand and then escapes from the filament so as to turn off the flasher. Sequentially, the metal piece is cooled down to shrink back the original shape and contacts the filament to turn on the flasher again. The respective thyristor diode in parallel with the flasher is used to sustain the current when the flasher is off so as to minimize the impact of abrupt current change on the flasher string for a longer lifetime.

2 Claims, 6 Drawing Sheets

FLASHER STRING

BACKGROUND OF THE INVENTION

1. Field of the Related Art

The present invention relates to a lamp string, and particularly, to a flasher string having thyristor diodes coupled with respective flashers in parallel to maintain the circuit loop even when some flashers turn off.

2. Background of the Related Art

The lamp string has been widely used to produce a twinkling light for decoration or celebration of specific festivals, especially at Christmas, as shown in FIG. 1. The lamp string of the prior arts has connecting wires 11 to connect the filaments 13 of the lamps 12 in series to form a loop, which is provided an appropriate voltage source S to turn on the lamps 12. With reference to FIG. 2, the flasher is often used as a switch to turn on or off all the lamps in series so as to create a tinkling light. The flasher 21 comprises a tungsten filament 22, a lamp filament 24 and a metal piece 23. The tungsten filament 22 is joint to the metal piece 23 and normally contacts the lamp filament 24, as shown in FIG. 2A. When the flasher 21 turns on to heat the metal piece 23 by conducting current, the metal piece 23 in contact with the lamp filament 24 is thermally distorted and then escapes from the lamp filament 24 to form an open loop, as shown in FIG. 2B, so that the flasher 21 turns off. Sequentially, the metal piece 23 is cooled down and then returns back to contact the lamp filament 24 so that the flasher 21 turns on again. The above process repeats until the power is cut off. As a result, all the lamps connected in series with the flasher 21 can be turned on or off at a time by turning on or off the flasher 21. Several such lamp strings with different on/off states at the same time may constitute a larger light source to produce a larger area of twinkling light. However, the sense of twinkling light is quite different from the natural star light at night because all the lamps in a specific lamp string should turn on or off simultaneously.

With reference to FIG. 3, another type of flasher 31 (FIG. 3A) with equivalent circuit in FIG. 3B comprises a tungsten filament 32 connected to a metal piece 33 in parallel, which is normally not in contact with a lamp filament 34. When the flasher 31 turns on, the metal piece 33 is thermally distorted towards and then contacts the lamp filament 34. As a result, the two lamp filaments 34, 35, are short circuited and all the current flows through the lamp filaments 34, 35 and the metal piece 33 without any current flowing through the tungsten filament 32 so that the flasher 31 turns off but the current loop is still closed. A lamp string consisting of such flashers 31 may produce a more natural twinkling light source because each flasher 31 can turn on or off independently. However, the current is quite unstable because the short circuited state of the flasher may abruptly increase the current to an extreme level to burn up the lamp filaments, especially when many flashers are short circuited at the same time.

SUMMARY OF THE INVENTION

The object of the present invention is to provide a lamp string having a plurality of flashers connected in series and a plurality of thyristor diodes, each thyristor diode connected to a respective flasher in parallel. Each flasher may turn on and off independently to produce a natural-like twinkling light without any impact on the conducting current so that the current is stable during operation.

DETAILED DESCRIPTION OF PREFERRED EMBODIMENTS

Figure 1:
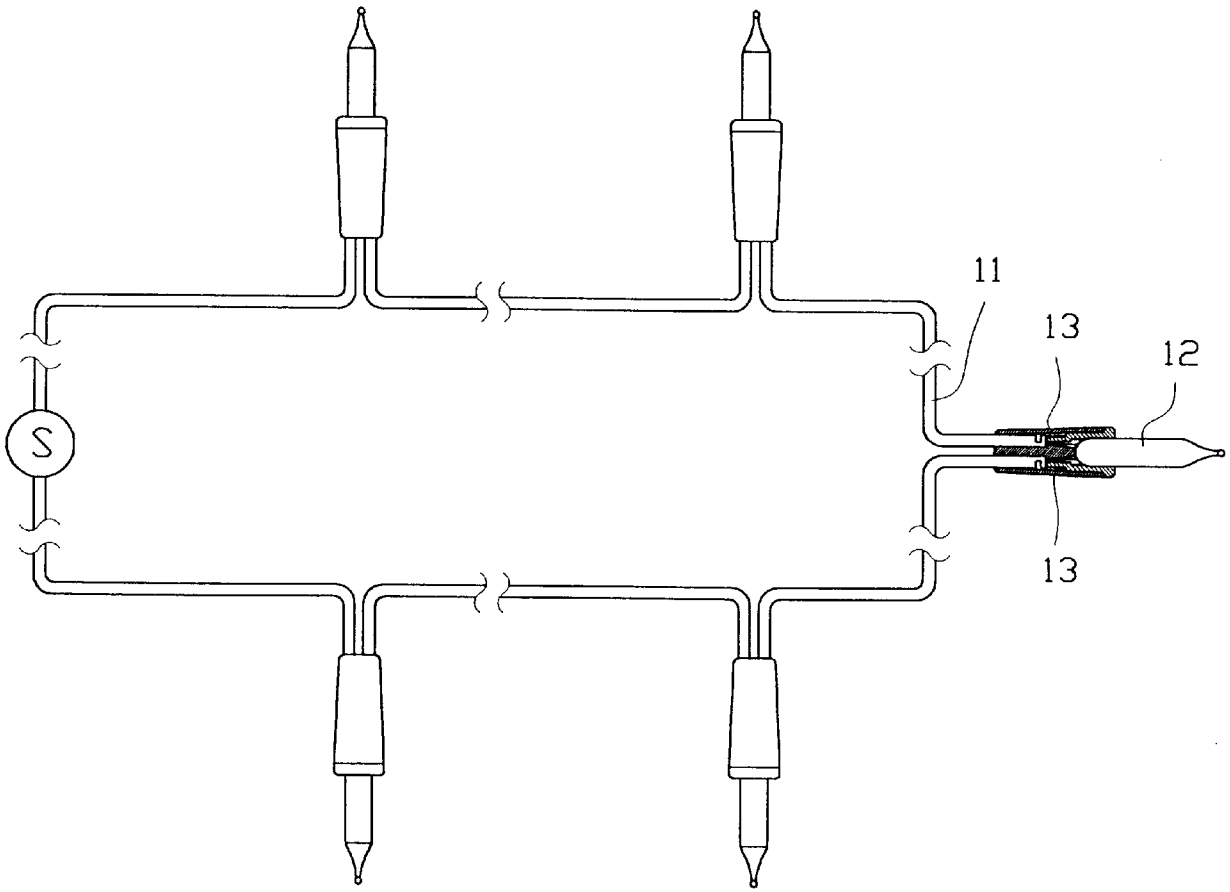
FIG.1 (PRIOR ART)
FIG. 1 shows a schematic circuit diagram of a lamp string in the prior arts.
Figure 2:
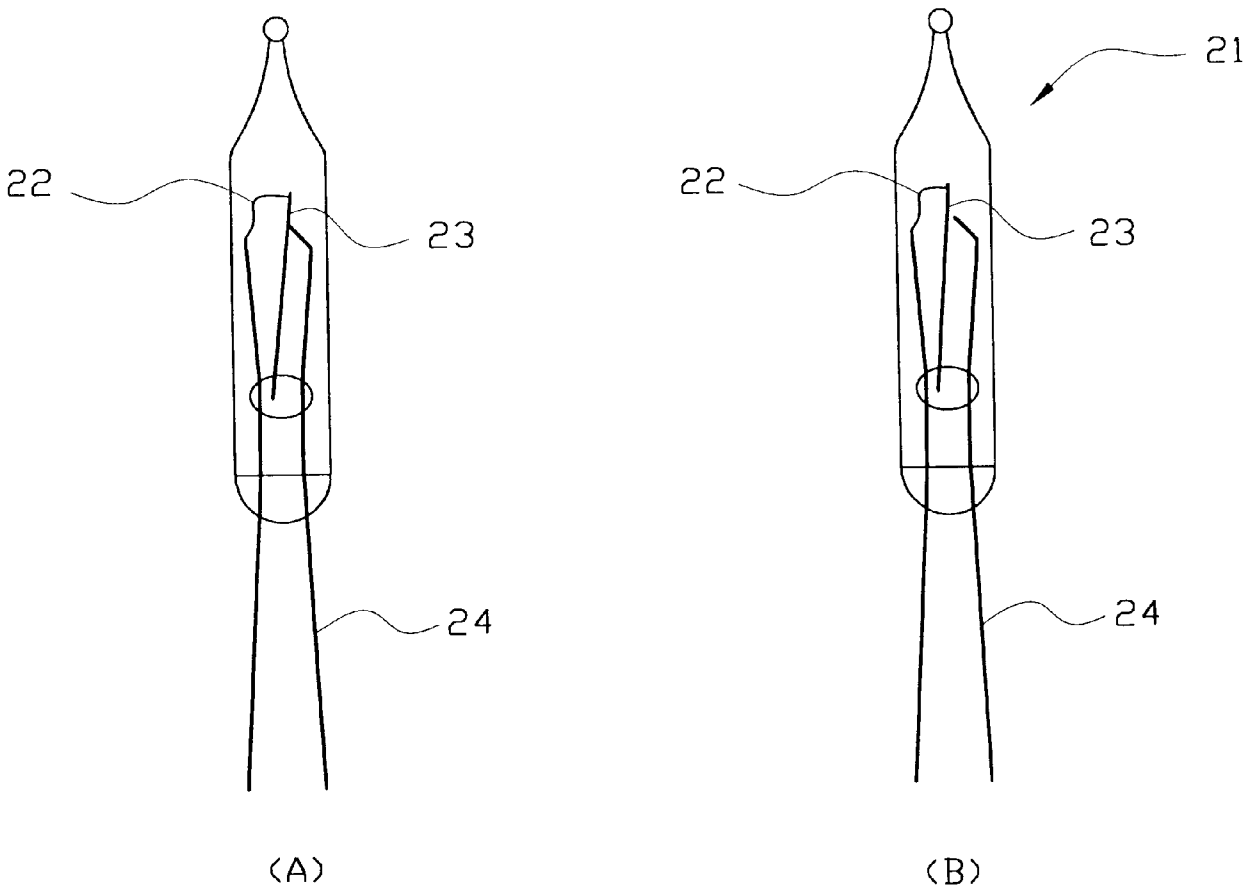
FIG. 2 is a schematic diagram of a flasher string.
Figure 3:
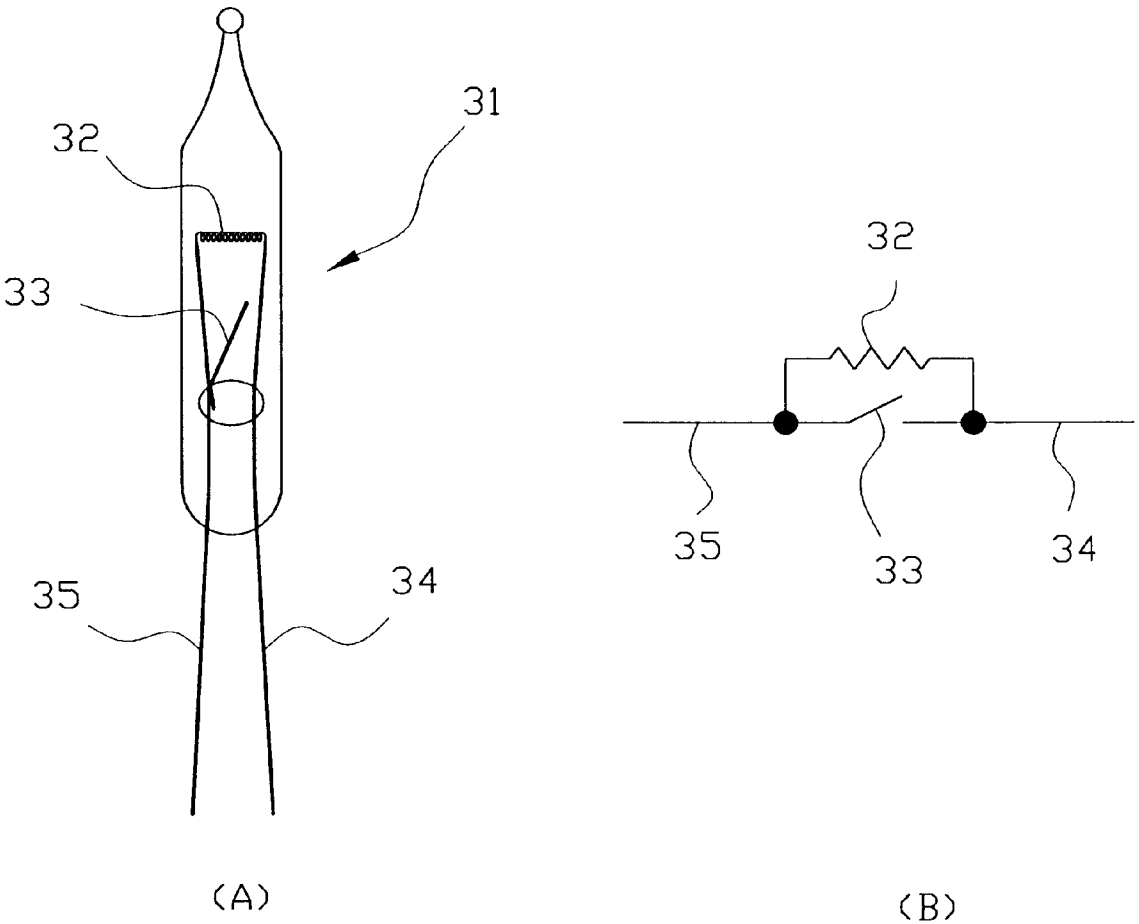
FIG. 3A is a schematic diagram of another flasher string.
FIG. 3B is an equivalent circuit of the flasher in FIG. 3A.
Figure 4:
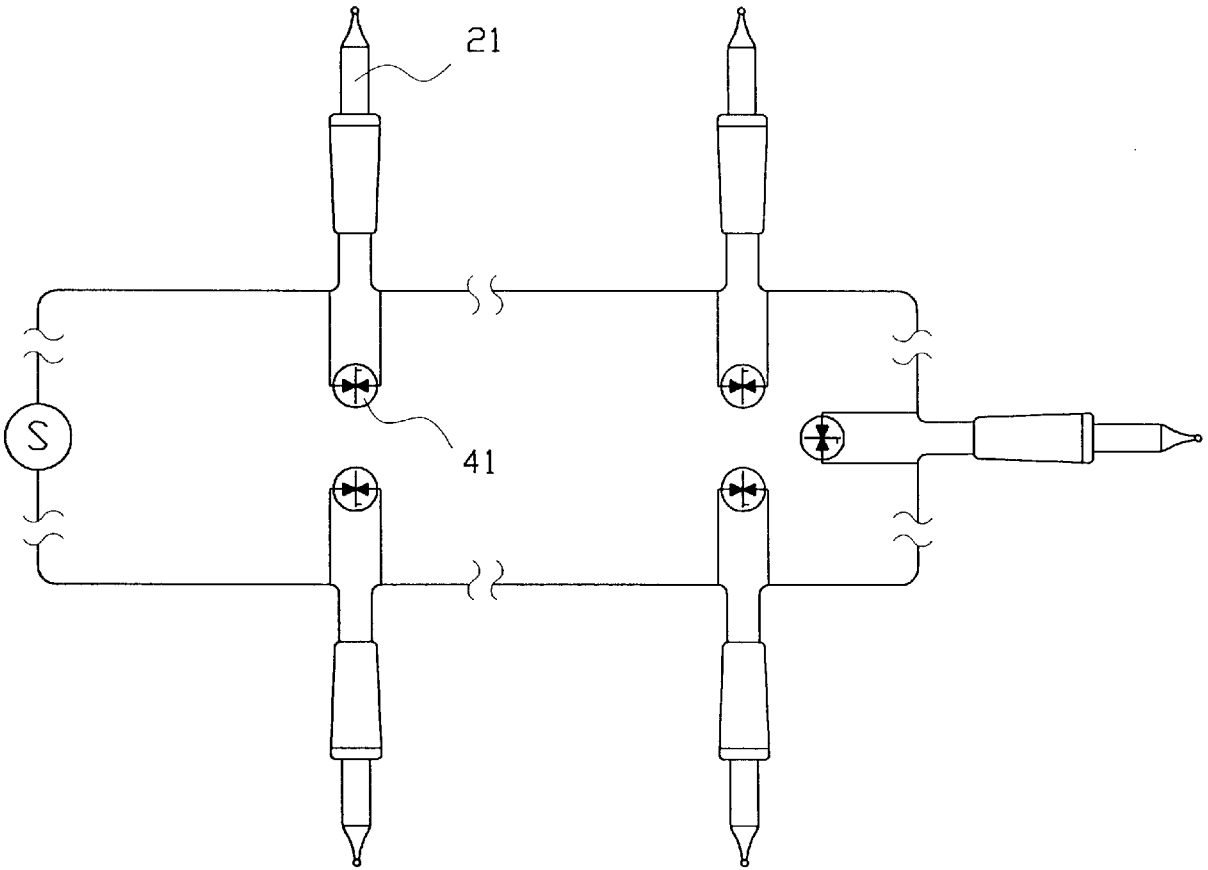
FIG. 4 shows the structure of a flasher string comprising flashers and thyristor diodes according to an embodiment of the present invention.
Figure 5:
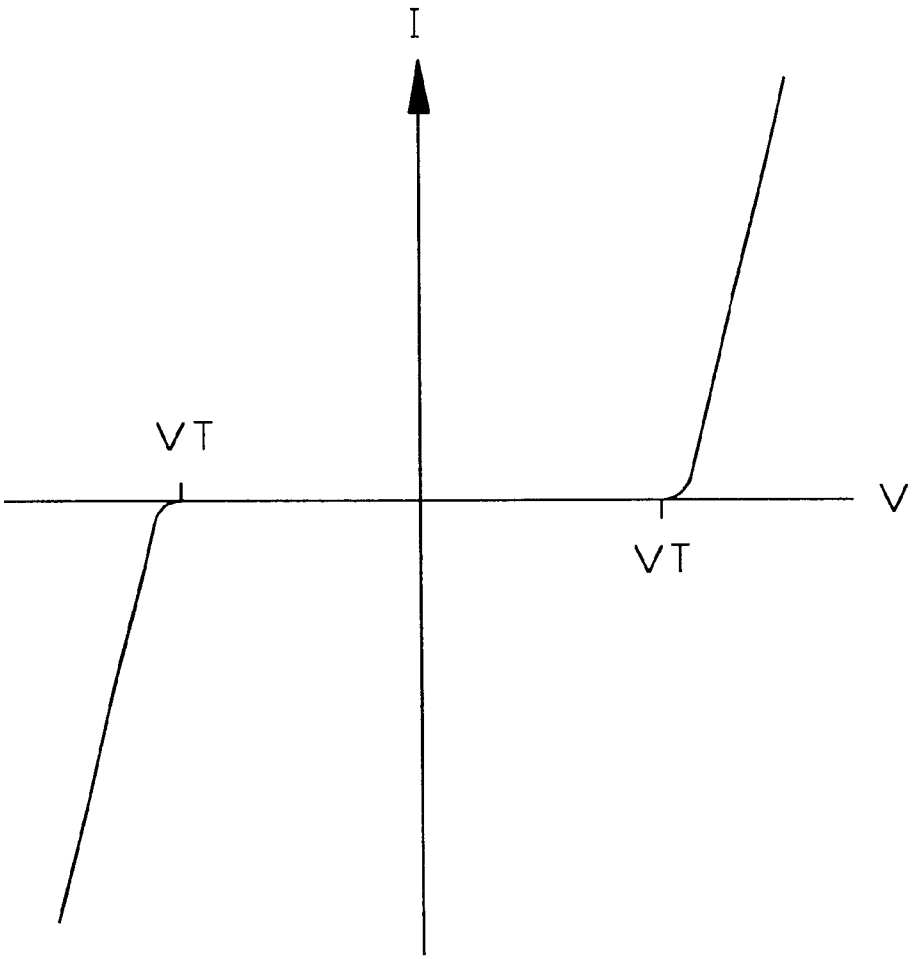
FIG. 5 illustrates the characteristic curve of the thyristor diode.

With reference to FIG. 4, the flasher string of the present invention comprises a plurality of flashers 21 in series and a plurality of thyristor diodes 41, each thyristor diode connected to a respective flasher in parallel so as to produce a twinkling light source in a background with steady light. FIG. 5 shows the characteristic curve of the thyristor diode. When external positive or negative voltage is greater than the positive or negative threshold voltage (VT), the thyristor diode turns on and has a terminal voltage kept to a predetermined VT with a stable and lower conducting current compared to the abrupt current in the prior art flasher as mentioned above. With this property, each flasher is connected to a respective thyristor diode 41 in parallel in the present invention. Therefore, the thyristor diode 41 can sustains a low level current to keep the current loop closed if the respective flasher turns off. When the voltage source has a greater terminal voltage than the summation of the VT values of all the thyristor diodes 41, the flashers 21 may turn on or off independently without such a current impact of the prior art on the flashers 41 so as to create a twinkling light source in a more natural sense.

The present invention provides a flasher string with a plurality of flasher units in series to create a twinkling light source, and each flasher unit consists of the flashers 21 and the thyristor diodes 41, each thyristor diode connected to the respective flasher in parallel. The Zener diode with a similar property compared to the thyristor diode can achieve the same function be the above connection. However, the Zener diode has polarity so that a rectifier is needed when an AC power source is used. Furthermore, the inconvenience in assembling the flasher string is influenced by the polarity of the Zener diode and it is potentially possible to assemble the Zener diode with wrong polarity resulting in bad flasher strings. The flasher string with the thyristor diodes in the present invention has no such a polarity issue.

Figure 6:
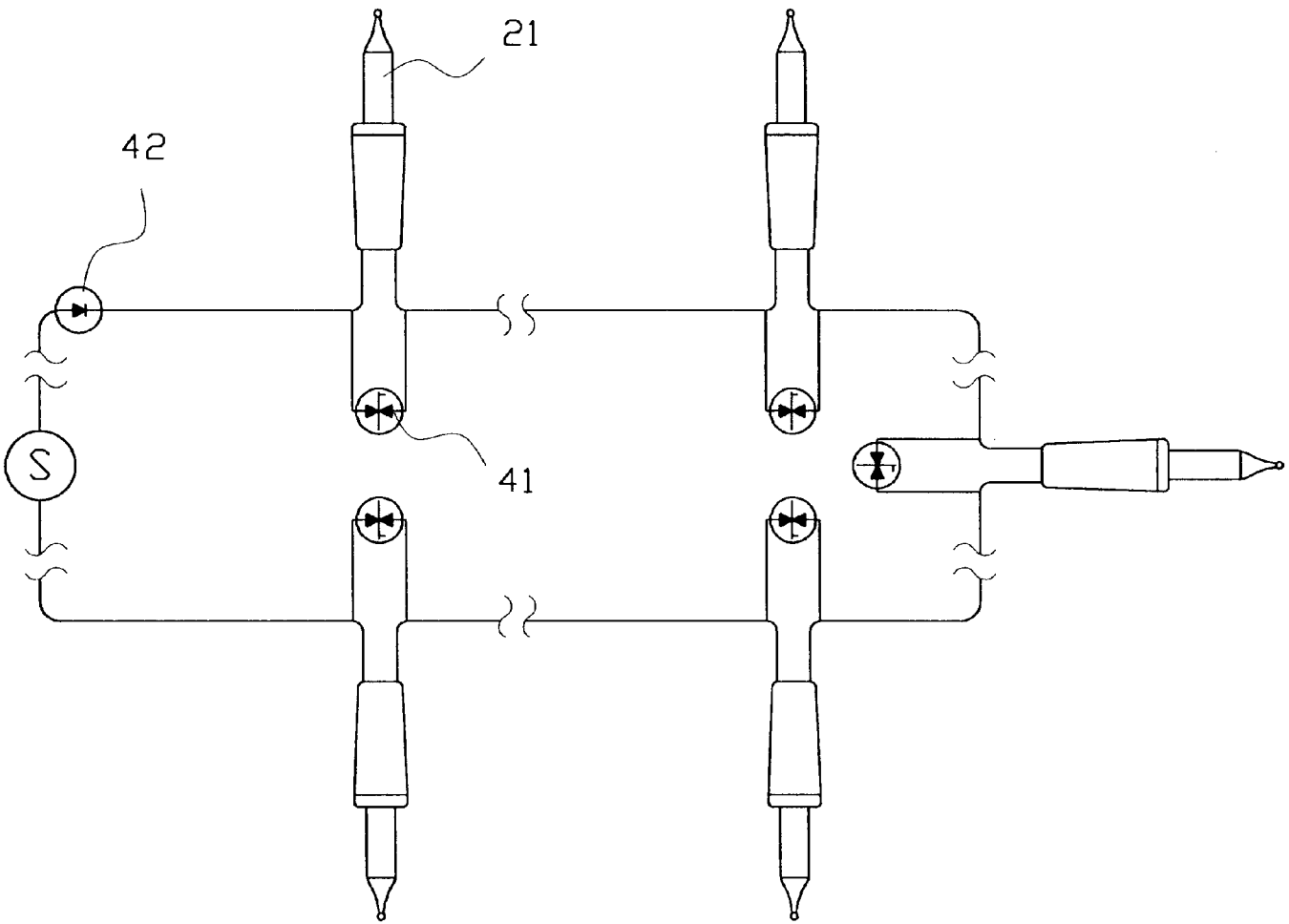
FIG. 6 is a schematic diagram of a flasher string according to another embodiment of the present invention.

Considering the power consumption of the flasher string in the present invention, a diode 42 (as shown in FIG. 6) used to rectify the AC power source causes the total voltage of the flashers reduced and each flasher to obtain lower terminal voltage such that the conducting current can still maintain the threshold current without any effect on the brightness of the flasher 21 to save the power consumption. Similarly, the thyristor diode connected to the flasher in parallel conducts lower current so as to reduce the power consumption and further prolong the lifetime.

The foregoing embodiments and advantages are merely exemplary and are not to be construed as limiting the present invention. Therefore, The description of the present invention is intended to be illustrative, and not to limit the scope of the claims. Many alternatives, modifications, and variations will be apparent to those skilled in the art and must be considered within the scope and spirit of the present invention.

What is claimed is:

1. A lamp string comprising:

a plurality of lamps connected in series, each lamp having a tungsten filament, a lamp filament and a metal piece normally contacting said tungsten filament, said metal piece being thermally distorted and disconnected from said tungsten filament when said metal piece is heated;

a plurality of thyristor diodes each being connected in parallel with one of said plurality of lamps and maintaining a terminal voltage near a threshold voltage when the metal piece and the tungsten filament of the corresponding lamp connected in parallel are disconnected;

wherein each thyristor diode maintains a substantially stable and low current without an abrupt change when a positive or negative voltage across said thyristor diode is greater than said threshold voltage.

2. A lamp string as claimed in claim 1 further comprising a diode connected in series with said plurality of lamps, said diode rectifying an AC power source for reducing power consumption of said lamp string.

* * * * *